US011491072B2

(12) United States Patent
Kim et al.

(10) Patent No.: US 11,491,072 B2
(45) Date of Patent: Nov. 8, 2022

(54) WEARABLE APPARATUS FOR ASSISTING MUSCULAR STRENGTH

(71) Applicants: Hyundai Motor Company, Seoul (KR); Kia Motors Corporation, Seoul (KR)

(72) Inventors: Kyu Jung Kim, Seoul (KP); Hyun Seop Lim, Gyeonggi-do (KR); Ki Hyeon Bae, Gyeonggi-do (KR); Ju Young Yoon, Gyeonggi-do (KR); Dong Jin Hyun, Gyeonggi-do (KR); Kyung Mo Jung, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 430 days.

(21) Appl. No.: 16/696,104

(22) Filed: Nov. 26, 2019

(65) Prior Publication Data

US 2020/0315897 A1 Oct. 8, 2020

(30) Foreign Application Priority Data

Apr. 4, 2019 (KR) ..... 10-2019-0039681

(51) Int. Cl.
*A61H 1/02* (2006.01)

(52) U.S. Cl.
CPC ... *A61H 1/0274* (2013.01); *A61H 2201/1623* (2013.01); *A61H 2201/1638* (2013.01);
(Continued)

(58) Field of Classification Search
CPC ... B25J 9/0006; B25J 9/16; B25J 19/02; B25J 9/109; B25J 9/106; A61H 1/0281;
(Continued)

(56) References Cited

U.S. PATENT DOCUMENTS 6,082,034 A 7/2000 Musmanno
10,071,477 B2 * 9/2018 Van Engelhoven ..... B65H 1/10
(Continued)

FOREIGN PATENT DOCUMENTS

KR 10-2016-0132156 11/2016
KR 10-1896181 B1 9/2018
WO 2018/082906 5/2018

*Primary Examiner* — Samchuan C Yao
*Assistant Examiner* — Minhua Zhao
(74) *Attorney, Agent, or Firm* — Fox Rothschild LLP

(57) ABSTRACT

A wearable apparatus for assisting muscular strength includes a back support, and a connection chain having a first end portion coupled to the back support to be rotatable upward or downward. The connection chain extends from the back of the wearer to a side thereof and includes a plurality of rotary elements arranged abreast laterally, each rotary element being rotatably coupled to an adjacent rotary element laterally. The wearable apparatus further includes an upper arm module that extends in a direction in which an upper arm of the wearer extends, one end portion of the upper arm module coupled to a second end portion of the connection chain to be rotatable upward or downward with respect to the one end portion. The upper arm module generates a rotational force for rotating the upper arm of the wearer upward or downward.

14 Claims, 7 Drawing Sheets

(52) U.S. Cl.
CPC ..... *A61H 2201/1652* (2013.01); *A61H 2201/1659* (2013.01)

(58) Field of Classification Search
CPC ..... A61H 1/1614; A61H 2201/165; A61H 2205/062; A61H 2205/08; A61H 2205/081
See application file for complete search history.

(56) References Cited

U.S. PATENT DOCUMENTS

| | | | | |
|---|---|---|---|---|
| 2011/0164949 | A1 | 7/2011 | Kim et al. | |
| 2014/0158839 | A1* | 6/2014 | Doyle | A61B 90/60 248/118 |
| 2016/0081871 | A1 | 3/2016 | Doyle | |
| 2017/0144309 | A1* | 5/2017 | Sankai | B25J 17/00 |
| 2018/0361565 | A1* | 12/2018 | Angold | B25J 9/106 |
| 2019/0083350 | A1* | 3/2019 | Weidner | B25J 9/0006 |

* cited by examiner

WEARABLE APPARATUS FOR ASSISTING MUSCULAR STRENGTH

CROSS REFERENCE TO RELATED APPLICATION

The present application claims the benefits of priority to Korean Patent Application No. 10-2019-0039681, filed on Apr. 4, 2019, the entire contents of which is incorporated herein by this reference.

BACKGROUND

1. Technical Field

The present disclosure relates to a wearable apparatus for assisting muscular strength, and more particularly, to an apparatus for providing an assistive force to an upper arm of the wearer when the apparatus is worn.

2. Description of the Related Art

A wearable robot, which may be worn on or placed on a specific portion of a human body to assist movement of the human body, has been designed for medical, military, or work purposes. In particular, a wearable robot for work purposes is designed to reduce a load applied to a worker to thus prevent injuries and support muscular strength. Such a wearable robot mimics the wearer's exoskeleton, and designing a joint to have the same motion as an actual motion of the human body is a core of the technology.

In particular, the wearable apparatus for assisting the upper arm muscular strength includes a passive support device configured to support a person who bears a weight of a tool. A typical passive device is configured to compensate for gravity under a range of positions using a combination of structural elements, springs, cables, and pulleys. The configuration of these devices provides gravity compensation within a limited operating range.

However, the wearable apparatus of related art for assisting muscular strength has a structure for supporting the wearer's upper arm to rotate upward, but a motion of rotating the wearer's upper arm forward or backward is limited, and rotation of a shoulder blade is limited in a motion of rotating the upper arm upward or downward, causing a problem that an operation range of the shoulder compound joint is limited. Further, a wearer's motion of leaning forward or back is also limited.

The contents described as the related art have been provided only to assist in understanding the background of the present disclosure and should not be considered as corresponding to the related art known to those having ordinary skill in the art.

SUMMARY

An object of the present disclosure is to provide a wearable apparatus for assisting muscular strength which may extend laterally from a back of a wearer through a connection chain to couple the connection chain to be rotatable upward or downward from the back of the wearer to thus mimic a rotating motion of the wearer's shoulder blade.

According to an exemplary embodiment of the present disclosure, a wearable apparatus for assisting muscular strength may include a back support configured to be disposed on a back of a wearer and fixedly supported on the back of the wearer, and a connection chain that extends to a side from the back of the wearer. A first end portion of the connection chain may be coupled to the back support to be rotatable upward or downward. The connection chain may include a plurality of rotary elements arranged abreast laterally, and each rotary element may be rotatably coupled to an adjacent rotary element laterally. The wearable apparatus may further include an upper arm module that extends in a direction in which an upper arm of the wearer extends, and a first end portion of the upper arm module may be coupled to a second end portion of the connection chain at a position that corresponds to an upper end portion of the upper arm of the wearer to be rotatable upward or downward with respect to the first end portion of the upper arm module. The upper arm module may generate a rotational force for rotating the upper arm of the wearer upward or downward.

The back support may include an upper plate disposed at a height that corresponds to a shoulder blade of the wearer. The back support may extend to have a plate-like shape, and may be in contact with the back of the wearer and supported thereon.

The rotary elements of the connection chain may extend to have a predetermined height in a vertical direction, and the each rotary element may be coupled to the adjacent rotary element to be rotatable laterally with respect to a rotary shaft that extends in the vertical direction and is arranged abreast.

The connection chain may be rotatably coupled to the back support at a first coupling point and a second coupling point spaced apart from each other in the vertical direction at the first end portion of the connection chain, and may be connected at the first coupling point sequentially to a first link and a second link that are coupled to be rotatable upward or downward to allow the connection chain to be coupled to the back support while being rotatable upward or downward. Further, the second link may be rotatably coupled to the back support at a rotation point spaced apart from the first coupling point.

The first coupling point may be disposed below the second coupling point. In particular, when the connection chain is rotated upward to a predetermined angle with respect to a ground, the first link and the second link may be linearly connected to restrain upward rotation of the connection chain. When the connection chain is parallel to a ground, a connection point at which the first link and the second link are rotatably coupled may be disposed below a line that connects the second coupling point and the rotation point.

The wearable apparatus may further include an elastic member that applies an elastic force to the first link or the second link to pull the connection point between the first link and the second link downward when the connection chain is rotated upward relative to a position parallel to the ground.

The first link and the second link may be rotatable to allow the connection point to be disposed above the line that connects the second coupling point and the rotation point, and the connection chain may be rotatable downward, relative to a position parallel to the ground, when the connection point is disposed above the line that connects the second coupling point and the rotation point.

The connection chain may include a plurality of rotary elements which have a predetermined lateral length, and are arranged laterally and rotatably coupled laterally to each other, and may extend from the back of the wearer to an outer side to allow the second end portion to extend to an outer side of the upper arm.

The back support may include an upper plate supported on the back of the wearer, a lower plate disposed below the upper plate and supported on the back of the wearer, and a support link that extends in a vertical direction and is connected to the upper plate and the lower plate. The lower plate may extend in a plate-like shape to correspond to a curve of the back of the wearer and may be supported on the back of the wearer at a height of a pelvis of the wearer. The lower plate may be coupled to the support link to be rotatable upward or downward. In particular, the lower plate may be coupled to the support link to be rotatable at a third coupling point and a fourth coupling point disposed to be spaced apart from each other in the vertical direction.

The third coupling point may be disposed below the fourth coupling point, and the third coupling point may be coupled to the support link at a position spaced apart from the fourth coupling point via a third link having each end rotatably coupled to the lower plate and the support link, respectively. The third link and the lower plate may be coupled to each other to be slidable in the vertical direction.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
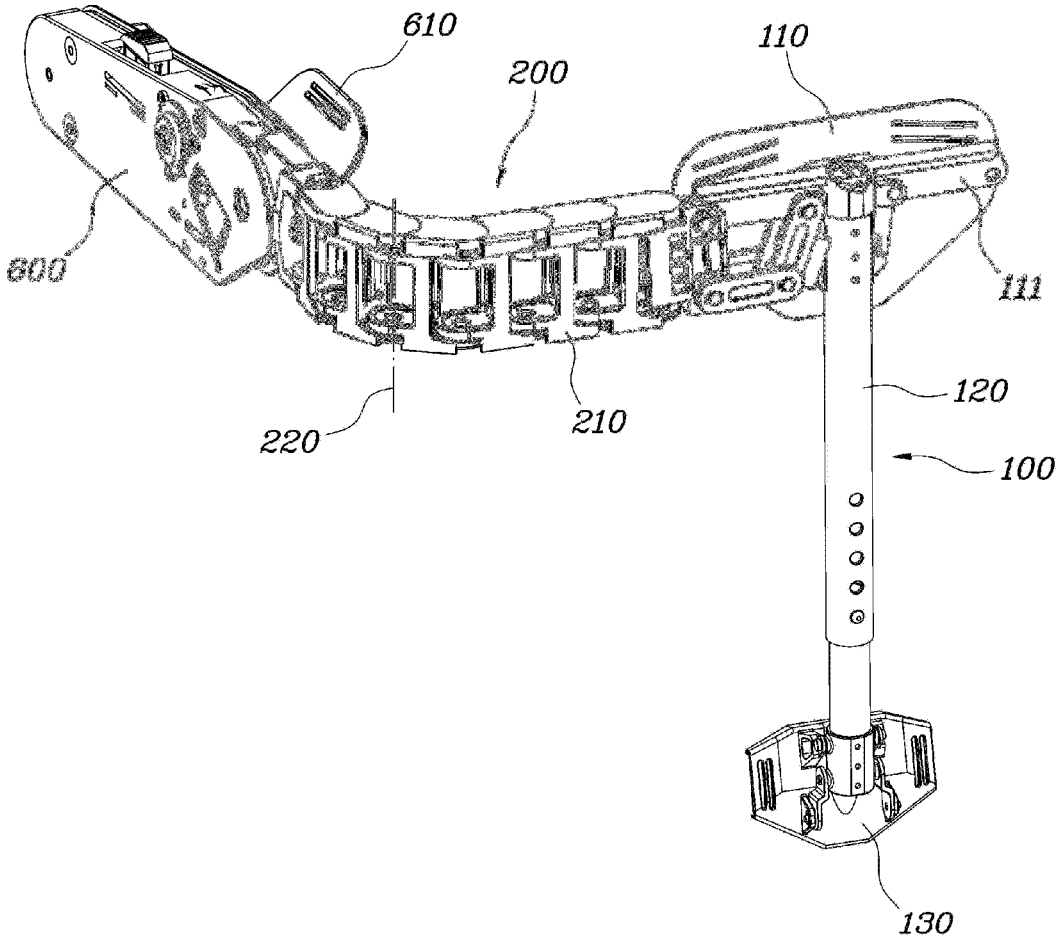
FIG. 1 is a rear perspective view of a wearable apparatus for assisting muscular strength according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Furthermore, control logic of the present disclosure may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Specific structural or functional descriptions of the exemplary embodiments of the present disclosure disclosed in the specification are exemplified for the purpose of describing the exemplary embodiments of the present disclosure only, and the exemplary embodiments of the present disclosure may be carried out in various forms and should not be construed to limit the exemplary embodiments described herein.

In the present disclosure, various modifications may be applied and various forms may be realized, and thus specific exemplary embodiments will be exemplified in the drawings and be described in detail in the specification. However, the present disclosure is not intended to limit to specific disclosure forms, and it will be appreciated that the present disclosure includes all changes, equivalents, or replacements included in the spirit and technical range of the present disclosure.

It will be understood that, although the terms first and/or second, etc. may be used herein to describe various elements, these elements should not be limited by these terms. These terms are only used to distinguish one element from another. For example, a first element may be termed a second element, and, similarly, a second element may be termed a first element, without departing from the scope of the present disclosure.

When it is mentioned that a certain element is "connected to" or "electrically connected to" a second element, the first element may be directly connected or electrically connected to the second element, but it should be understood that a third element may intervene therebetween. On the other hand, when it is mentioned that a certain element is "directly connected to" or "directly electrically connected to" a second element, it should be understood that there is no third element therebetween. Other expressions for describing a relationship between constituent elements such as "between" and "directly between, or "adjacent to" and "directly adjacent to" are construed in the same way.

Unless defined in a different way, all terms used herein including technical and scientific terms have the same meanings as understood by those skilled in the art to which the present disclosure pertains. Such terms as defined in generally used dictionaries should be construed to have the same meanings as those of the contexts of the related art, and unless clearly defined in the application, they should not be construed to have ideally or excessively formal meanings.

Hereinafter, exemplary embodiments of the present disclosure will be described in detail with reference to the accompanying drawings. The same constituent elements in the drawings are denoted by the same reference numerals. FIG. 1 is a rear perspective view of a wearable apparatus for assisting muscular strength according to an exemplary embodiment of the present disclosure, and FIG. 2 is a rear view of the wearable apparatus for assisting muscular strength according to an exemplary embodiment of the present disclosure.

Figure 2:
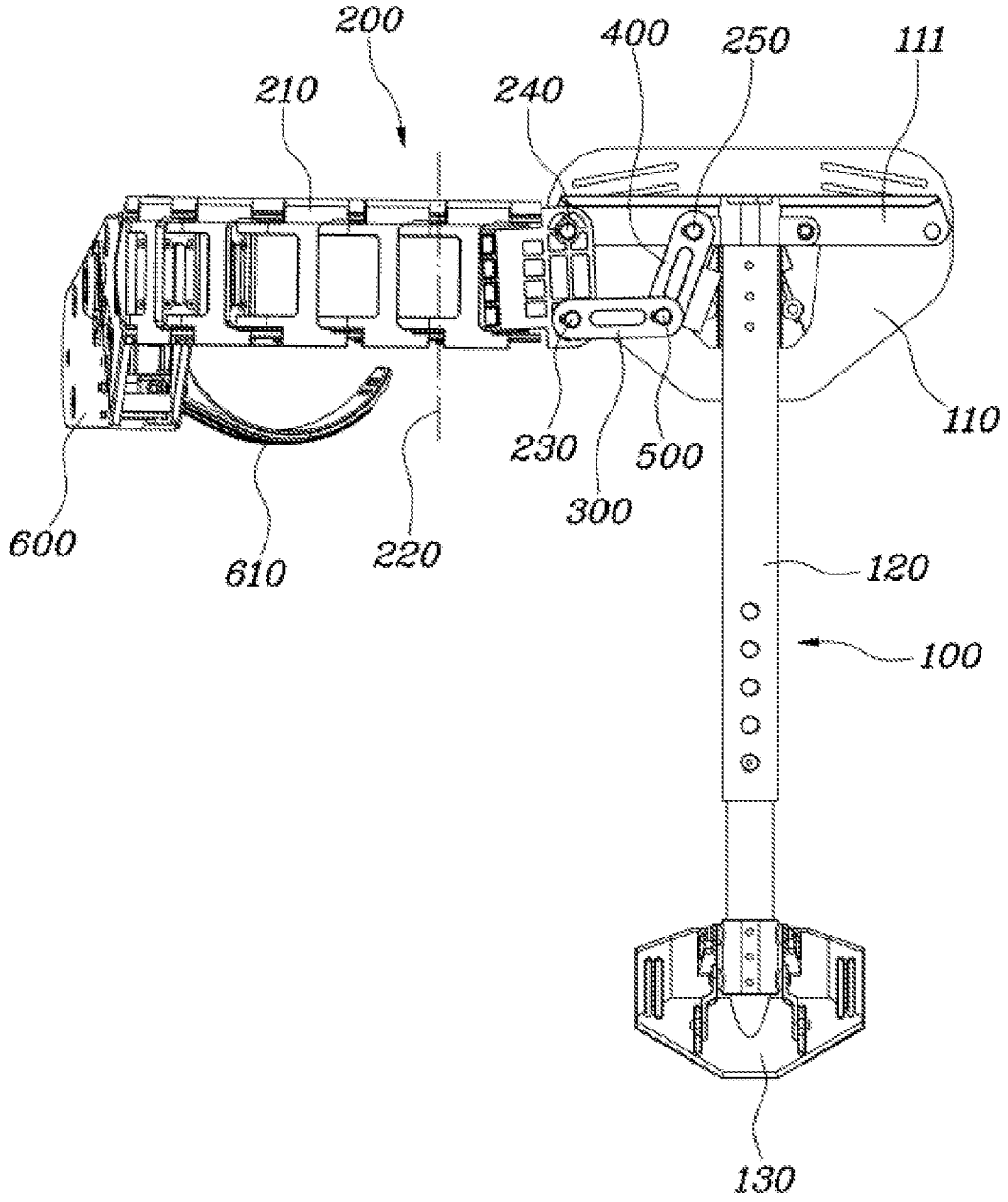
FIG. 2 is a rear view of a wearable apparatus for assisting muscular strength according to an exemplary embodiment of the present disclosure.

Referring to FIGS. 1 and 2, a wearable apparatus for assisting muscular strength according to an exemplary embodiment of the present disclosure may include a back support 100 configured to be disposed on a back of a wearer and fixedly supported on the back of the wearer; and a connection chain 200 having a first end portion coupled to the back support 100 to be rotatable upward or downward. The connection chain 200 may include a plurality of rotary elements 210 arranged abreast laterally, and each rotary element 210 may be rotatably coupled to an adjacent rotary element 210 laterally and the connection chain 200 may extend to be bent from the back of the wearer to a side thereof. The wearable apparatus for assisting muscular strength according to an exemplary embodiment of the present disclosure may further include an upper arm module 600 that extends in a direction in which the wearer's upper arm extends, and one end portion thereof may be coupled to a second end portion of the connection chain 200 at a position that corresponds to an upper end portion of the wearer's upper arm to be rotatable upward or downward with respect to the one end portion of the upper arm module 600, and may generate a rotational force for rotating the wearer's upper arm upward or downward.

The back support 100 may be coupled to the back of the wearer and support a reaction force due to the rotational force that is exerted on the upper arm module 600. The back support 100 may be coupled to the body of the wearer by a harness or the like.

The connection chain 200 may be configured by connecting the plurality of rotary elements 210, and the plurality of rotary elements 210 may be arranged abreast laterally and connected to each other. In particular, each of the rotary elements 210 may be coupled to an adjacent rotary element 210 to be laterally rotatable by a rotary shaft 220 that extends in a vertical (e.g., up-down) direction. The connection chain 200 may extend to be bent from the back of the wearer to the side thereof. The connection chain 200 may extend from the first end portion, and the rotary element 210 may be rotated forward from an adjacent rotary element 210, and thereby the connection chain 200 may be bent forward.

The upper arm module 600 may extend in the direction in which the upper arm of the wearer extends to correspond to the upper arm of the wearer. One end portion of the upper arm module 600 may be coupled to the second end portion of the connection chain 200 at a position that corresponds to the upper end portion of the wearer's upper arm. In particular, the upper arm module 600 may be rotatable upward or downward with respect to the one end portion thereof coupled to the second end portion of the connection chain 200 and may generate a rotational force to rotate the wearer's upper arm upward or downward with respect to the upper end portion of the upper arm module 600.

Specifically, the upper arm module 600 may include an elastic member (not shown) such as a spring for generating an elastic force, and the elastic member (not shown) may be connected to a wire configured to be wound or unwound based on an angle at which the upper arm module 600 is rotated at the second end portion of the connection chain 200 with respect to the first end portion thereof, to allow the elastic force of the elastic member (not shown) to vary depending on a rotation angle of the upper arm module 600.

The rotational force may be a torque that varies depending on a magnitude of the elastic force and a direction in which the elastic force is exerted. In particular, the upper arm module 600 may further include a cam around which a wire is wound or which induces deformation of the elastic member 510 depending on a rotation angle of the upper arm module 600 to design a torque profile based on the rotation angle of the upper arm module 600.

The upper arm module 600 may be disposed on the outer side of the wearer's upper arm, and the support 610 that surrounds a lower portion of the wearer's upper arm and extends to an inner side may apply a rotational force while supporting the lower portion of the wearer's upper arm. Accordingly, the wearable apparatus for assisting muscular strength of the present disclosure may be brought into close contact with the back and side of the wearer by the connection chain 200 and have an effect of simulating (e.g., mimicking) a motion of the wearer of freely rotating the upper arm forward or backward.

The back support 100 may include an upper plate 110 positioned at a height that corresponds to a shoulder blade of the wearer and extends in a plate-like shape to be supported in contact with the back of the wearer. The upper plate 110 may be disposed at the height that corresponds to the shoulder blade of the wearer and may particularly extend to the side the wearer. The first end portion of the connection chain 200 may be coupled to the upper plate 110 and the second end portion of the connection chain 200 may extend from a position that corresponds to an upper end portion of the wearer's upper arm in a direction parallel to the ground (e.g., perpendicular to a gravity direction) to be coupled to the one end portion of the upper arm module 600.

The upper plate 110 may be formed in a shape that corresponds to a curved body of the wearer or may be formed of a flexible material. The upper plate 110 may further include an upper link 111 integrally coupled to the upper plate 110 and laterally extended. The upper link 111 may be formed of a rigid material, and the connection chain 200 may be coupled to the upper link 111.

The rotary elements 210 that constitutes the connection chain 200 may extend to have a predetermined height in a vertical direction, and each of the rotary elements 210 may be coupled to the adjacent rotary element 210 to be laterally rotatable with respect to rotational shafts 220 that extend in the vertical direction and are arranged abreast. The rotary elements 210 may be rotatably coupled to each other via the rotation shafts 220 that extend in the vertical direction and may extend laterally abreast. The rotary elements 210 may be coupled while being capable of rotating to the front side of the wearer, and the connection chain 200 may be bent from the back of the wearer to the side.

The connection chain 200 may include a plurality of rotary elements 210 having a predetermined lateral length and arranged abreast to be coupled to each other while being laterally rotatable. The connection chain 200 may be bent from the back of the wearer to the outer side to allow the second end portion to extend to the outer side of the upper arm.

In addition, in an order of extending from the first end portion of the connection chain 200 to the second end portion of the connection chain 200, a limiting protrusion (not shown) may be formed to limit the rotary elements 210 to be rotatable within an angular range from the side of the wearer toward the front from a previous rotary element 210 and to prevent the rotary elements 210 from rotating in an angular range from the side of the wearer toward the back. Accordingly, the wearer may be protected from being injured when the wearer's upper arm is rotated backward.

The connection chain 200 may be rotatably coupled to the back support 100 at a first coupling point 230 and a second coupling point 240 spaced apart from each other in the vertical direction at the first end portion of the connection chain 200, and the connection chain 200 may be coupled to the back support 100 to be rotatable upward or downward by being connected at the first coupling point 230 sequentially to a first link 300 and a second link 400 that are rotatably coupled to each other at a coupling point 230. Further, the second link 400 may be rotatably coupled to the back support 100 at a rotation point 250 spaced apart from the first coupling point 230.

The first end portion of the connection chain 200 may be coupled to the back support 100 to be rotatable upward or downward, and in particular, may be rotatably coupled to the back support 100 at the first coupling point 230 and the second coupling point 240. The first coupling point 230 may be formed at a position spaced apart from the second coupling point 240 in the vertical direction, the first link 300 may be coupled to the first coupling point 230 to be rotatable upward or downward, the second link 400 may be coupled to the first link 300 to be rotatable upward or downward, and the second link 400 may be rotatably coupled to the back support 100 (in particular, the upper link 111). In particular, the second link 400 may be coupled to the upper link 111 at the rotation point 250 spaced apart from the first coupling point 230.

In contrast, the second coupling point 240 may be disposed on the back support 100. In particular, the second coupling point 240 may be disposed at the upper link 111, and the first end portion of the connection chain 200 may be directly coupled to the upper link 111 at the second coupling point 240. The second coupling point 240 may be disposed at the upper link 111 and laterally spaced apart from the rotation point 250. In other words, the connection chain 200 may be coupled to the back support 100 by a four-bar linkage structure formed by the first end portion of the connection chain 200, the first link 300, the second link 400, and the upper link 111. Accordingly, the connection chain 200 may be stably coupled to the back support 100 to be rotatable upward or downward.

Figure 3:
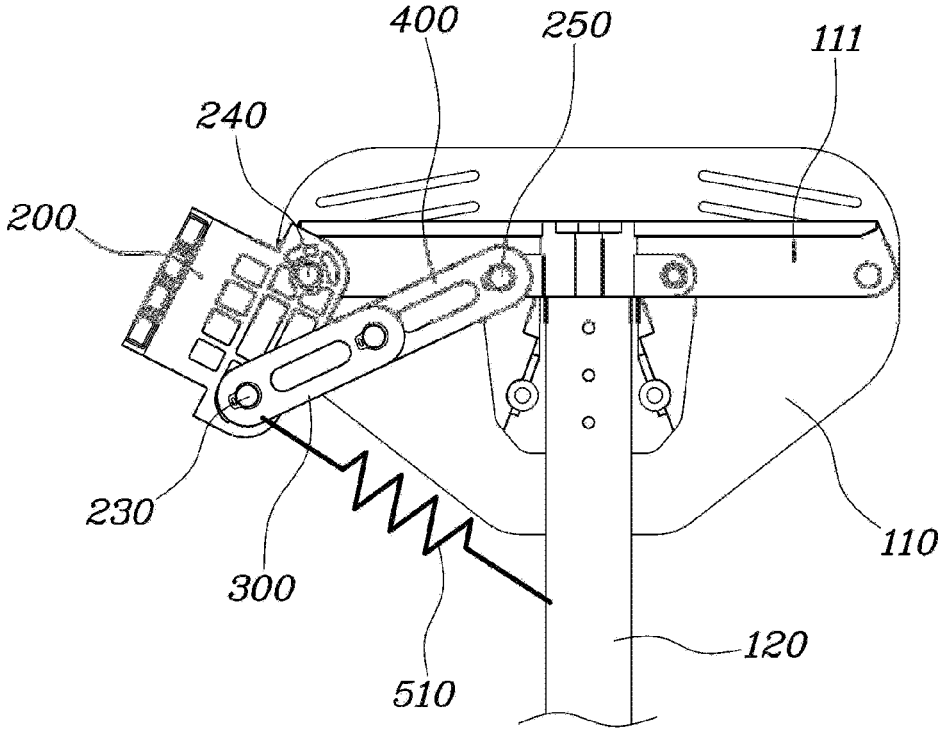
FIG. 3 illustrates a state in which a connection chain of a wearable apparatus for assisting muscular strength according to an exemplary embodiment of the present disclosure is rotated upward.

FIG. 3 illustrates a state in which the connection chain 200 of the wearable apparatus for assisting muscular strength according to an exemplary embodiment of the present disclosure is rotated upward. Referring to FIG. 3, the first coupling point 230 may be disposed below the second coupling point 240, and when the connection chain 200 is rotated by a predetermined angle upward with respect to the ground (e.g., with respect to the upper link 111), the first link 300 and the second link 400 may be linearly connected to restrain further upward rotation of the connection chain 200.

When a shoulder joint of the wearer is not rotated upward or downward, the connection chain 200 may extend laterally in parallel to the ground (e.g., the upper link 111). The first link 300 and the second link 400 may be coupled to form a predetermined angle rather than a line when the connection chain 200 is parallel to the ground.

When the connection chain 200 is rotated upward with respect to the ground, the first link 300 and the second link 400 may be unfolded to allow an angle therebetween to gradually approach 180°, and when the connection chain 200 is rotated to the predetermined angle upward with respect to the ground, the first link 300 and the second link 400 may be connected in a linear arrangement to restrain the chain 200 from being rotated further upward. Accordingly, the wearer's shoulder joint may be prevented from rotating beyond a predetermined angle, thereby protecting the wearer from being injured.

In particular, when the first coupling point 230 is disposed below the second coupling point 240, and the connection chain 200 is parallel to the ground, a connection point 500 at which the first link 300 and the second link 400 are rotatably coupled to each other may be disposed below a line that connects the second coupling point 240 and the rotation point 250. In other words, the first link 300 and the second link 400 may be connected to be bent downward to allow the connection point 500 at which the first link 300 and the second link 400 are rotatably coupled to each other to be disposed below a position of the connection point 500 when the first link 300 and the second link 400 are connected linearly.

The wearable apparatus may further include an elastic member 510 coupled to the first link 300 or the second link 400, and the elastic member 510 may apply an elastic force to the first link 300 or the second link 400 to pull the connection point 500 between the first link 300 and the second link 400 downward, when the connection chain 200 is rotated upward with respect to a state in which the connection chain 200 is parallel to the ground. A first end of the elastic member 510 may be coupled to the connection point 500 at which the first link 300 and the second link 400 are coupled to each other to apply an elastic force or may be coupled to any one of the first link 300 or the second link 400. Further, a second end of the elastic member 510 may be coupled to the back support 100.

When the connection chain 200 is parallel to the ground, the elastic member 510 may be undeformed in length to prevent the elastic member 510 from applying an elastic force. When the connection chain 200 is rotated upward or downward with respect to the ground, the elastic member 510 may apply an elastic force. Accordingly, even after the first link 300 and the second link 400 form a line, the first link 300 and the second link 400 may be rotated to allow the connection point 500 to move downward, and when an external force is removed, the connection chain 200 may be maintained in a state of being parallel to the ground.

Figure 4:
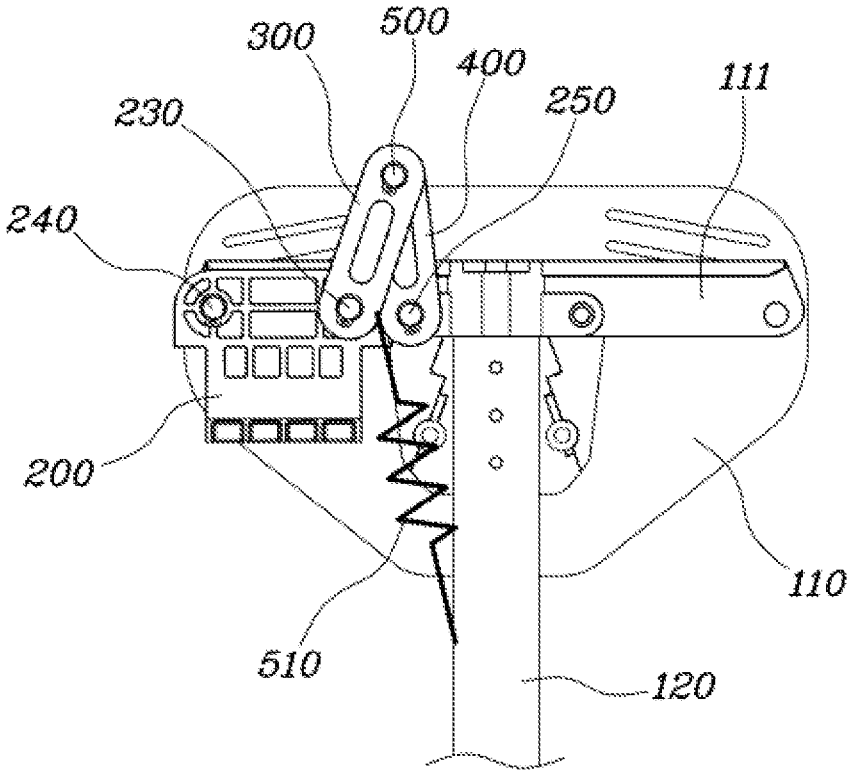
FIG. 4 illustrates a folded state of a connection chain of a wearable apparatus for assisting muscular strength according to an exemplary embodiment of the present disclosure.

FIG. 4 illustrates a folded state of the connection chain 200 of the wearable apparatus for assisting muscular strength according to an exemplary embodiment of the present disclosure. Referring to FIG. 4, the first link 300 and the second link 400 may be rotated to allow the connection point 500 to be disposed above a line that connects the second coupling point 240 and the rotation point 250, and the connection chain 200 may be rotated downward, relative to a state in which the connection chain 200 is parallel to the ground, when the connection point 500 is disposed above the line that connects the second coupling point 240 and the rotation point 250.

The first link 300 and the second link 400 may be connected to each other to be bent downward by an elastic force of the elastic body 510, and may be connected to be bent upward by an external force. Accordingly, the connection point 500 may be disposed above the line that connects the second coupling point 240 and the rotation point 250. In other words, when the connection chain 200 is rotated to fold the wearable apparatus for assisting muscular strength according to the present disclosure for transporting or storing the wearable apparatus, the first link 300 and the second link 400 may be bent upward, whereby the connection chain 200 may be rotated downward to be folded without intervention of the first link 300 and the second link 400.

The back support 100 may include an upper plate 110 supported on the back of the wearer, a lower plate 130 disposed below the upper plate 110 and supported on the back of the wearer, and a support link 120 that extends in a vertical direction and is connected to the upper plate 110 and the lower plate 130. The upper plate 110 and the lower plate 130 may be in contact with the back of the wearer at positions that correspond to the shoulder blade and pelvis of the wearer to be supported. The upper plate 110 and the lower plate 130 may be coupled to the wearer's body in order to counter-balance a reaction force of a rotational force that is exerted on the upper arm module 600 at the wearer's body. Specifically, the upper plate 110 and the lower plate 130 may be connected to the wearer's shoulder and waist, respectively, by a harness.

Figure 5:
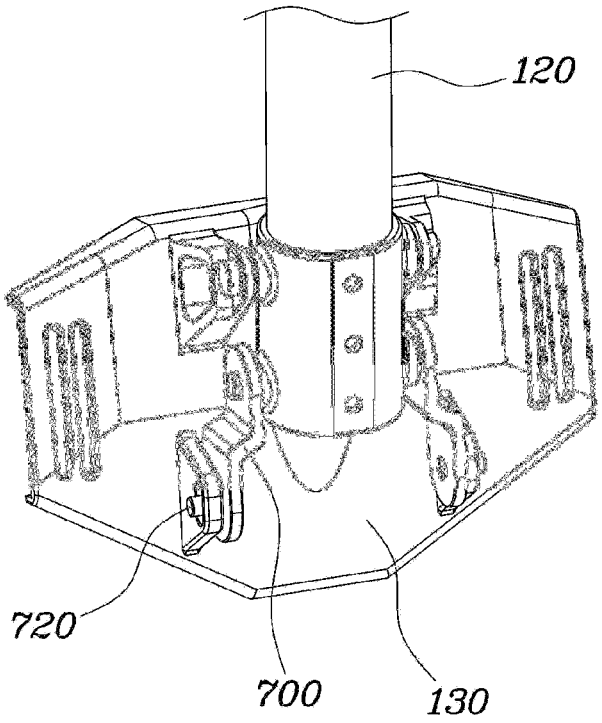
FIG. 5 illustrates a lower plate of a wearable apparatus for assisting muscular strength according to an exemplary embodiment of the present disclosure.

FIG. 5 illustrates the lower plate 130 of the wearable apparatus for assisting muscular strength according to an exemplary embodiment of the present disclosure. Referring to FIG. 5, the lower plate 130 may extend in a plate-like shape to correspond to a curve of the back of the wearer and may be supported on the back of the wearer at a height of the wearer's pelvis. The lower plate 130 may be brought into contact and coupled with the back of the wearer by a harness that surrounds the wearer's waist. In particular, the lower plate 130 may have a shape that corresponds to a curve of the back of the wearer and may be formed to correspond to a curve that extends from the pelvis of the wearer to the hip of the wearer to be in close contact and coupled with the back of the wearer.

Figure 6:
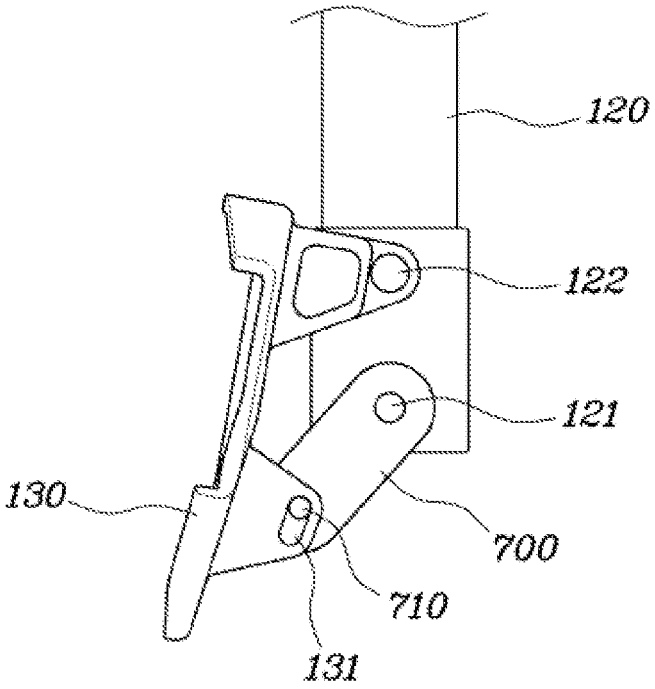
FIGS. 6 and 7 illustrate states in which a lower plate of a wearable apparatus for assisting muscular strength according to the exemplary embodiment of the present disclosure is rotated upward and downward, respectively.
Figure 7:
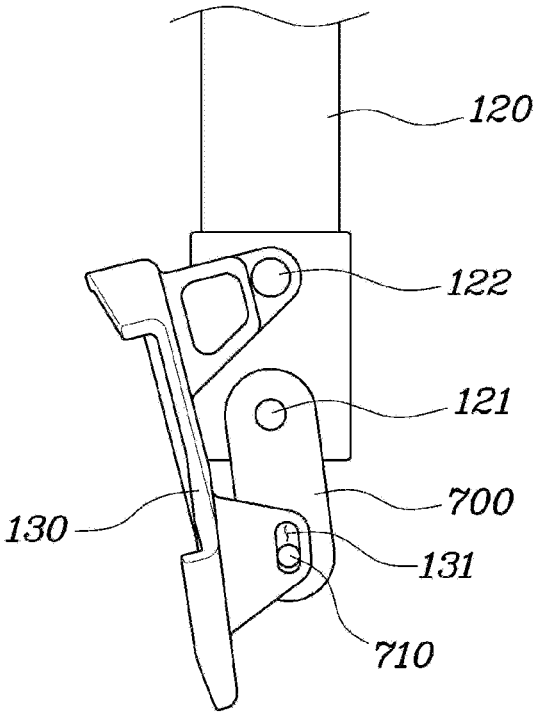

FIGS. 6 and 7 illustrate states in which the lower plate 130 of a wearable apparatus for assisting muscular strength according to an exemplary embodiment of the present disclosure is rotated upward and downward, respectively. Referring to FIGS. 6 and 7, the lower plate 130 may be coupled to the support link 120 to be rotatable upward or downward. Specifically, the lower plate 130 may be coupled to the support link 120 that extends in a vertical direction and may be coupled to the support link 120 to be rotatable upward or downward. Accordingly, the wearable apparatus for assisting muscular strength of the present disclosure may simulate a forward bending motion of the wearer's waste or a back straightening motion of the wearer.

The lower plate 130 may be rotatably coupled to the support link 120 at a third coupling point 121 and a fourth coupling point 122 spaced apart from each other in a vertical direction. Accordingly, since the lower plate 130 is rotatably coupled to the support link 120 at the third coupling point 121 and the fourth coupling point 122, the lower plate 130 may be rotatably coupled to the support link 120. In particular, the lower plate 130 may protrude toward the support link 120 disposed behind the lower plate 130 and may be coupled to the third coupling point 121 and the fourth coupling point 122 on the rear side relative to a position in contact with the back of the wearer. In other words, since the lower plate 130 is coupled to the support link 120 at a position partially protruding to the rear side of the lower plate 130 that extends to have a plate-like shape, although the lower plate 130 is rotated with respect to the support link 120, an interference may be prevented.

The third coupling point 121 may be disposed below the fourth coupling point 122 and may be coupled to the support link 120 at a position spaced apart from the fourth coupling point 122 through a third link 700 having each end rotatably coupled to the lower plate 130 and the support link 120, respectively. A first end of the third link 700 may be coupled to the lower plate 130 to be rotatable upward or downward, and a second end thereof may be coupled to the support link 120 to be rotatable upward or downward, and thus to link the lower plate 130 and the support link 120 at the third coupling point 121. The third link 700 may be formed on both sides of the support link 120 to connect the support link 120 and the lower plate 130 to each other. In particular, the second end of the third link 700 may be coupled to the support link 120 at a position spaced apart from the fourth coupling point 122 in a vertical direction.

Further, the third link 700 and the lower plate 130 may be coupled to each other to be slidable in the vertical direction. In an exemplary embodiment, a sliding protrusion 710 may be formed at the first end of the third link 700, and a sliding recess 131 that extends in the vertical direction may be formed on the lower plate 130. In particular, the sliding recess 131 may be formed at a portion that protrudes backward from the lower plate 130. The sliding protrusion 710 of the third link 700 may be partially slidably coupled in the vertical direction along the sliding recess 131 of the lower plate 130. In other words, as illustrated in FIGS. 6 and 7, as the lower plate 130 is rotated with respect to the support link 120, the third link 700 may be rotated, and simultaneously, the sliding protrusion 710 may slide along the sliding recess 131. Accordingly, the wearable apparatus for assisting muscular strength of the present disclosure may allow the wearer's motion of leaning forward or back, thus having an effect of naturally and stably simulating the motion.

According to the wearable apparatus for assisting muscular strength of the present disclosure, the upper arm of the wearer may be freely rotated laterally. Further, the shoulder joint of the wearer may be rotated upward or downward within an angular range limited to a rotatable range by the rotation of the shoulder blade. The back support supported on the back of the wearer may allow the upper body of the wearer to be bent or straightened.

Although the present disclosure has been shown and described with respect to specific exemplary embodiments, it will be apparent to those having ordinary skill in the art that the present disclosure may be variously modified and altered without departing from the spirit and scope of the present disclosure as defined by the following claims.

What is claimed is:

1. A wearable apparatus for assisting muscular strength, the wearable apparatus comprising:

a back support disposed on a back of a wearer and fixedly supported on the back of the wearer;

a connection chain that extends to a side from the back of the wearer, wherein a first end portion of the connection chain is coupled to the back support to be rotatable upward or downward, and the connection chain includes a plurality of rotary elements arranged abreast laterally, each rotary element being rotatably coupled to an adjacent rotary element laterally; and an upper arm module that is configured to extend in a direction in which an upper arm of the wearer extends, wherein a first end portion of the upper arm module is coupled to a second end portion of the connection chain via one rotary element of the plurality of rotary elements at a position that corresponds to an upper end portion of the upper arm of the wearer to be rotatable upward or downward with respect to the first end portion of the upper arm module, and the upper arm module generates a rotational force for rotating the upper arm of the wearer upward or and downward wherein the connection chain is rotatably coupled to the back support at a first coupling point and a second coupling point spaced apart from each other in a vertical direction at the first end portion of the connection chain, wherein the connection chain is connected at the first coupling point sequentially to a first link and a second link that are coupled to be rotatable upward and downward to allow the connection chain to be coupled to the back support while being rotatable and downward, and wherein the second link is rotatably coupled to the back support at a rotation point spaced apart from the first coupling point.

2. The wearable apparatus of claim 1, wherein the back support includes an upper plate disposed at a height that corresponds to a shoulder blade of the wearer, extending to have a plate-like shape, and configured to be in contact with the back of the wearer and supported thereon.

3. The wearable apparatus of claim 1, wherein the rotary elements of the connection chain extends to have a predetermined height in a vertical direction, and the each rotary element is coupled to the adjacent rotary element to be rotatable laterally with respect to a rotary shaft that extends in the vertical direction and is arranged abreast.

4. The wearable apparatus of claim 1, wherein the first coupling point is disposed below the second coupling point, and wherein, when the connection chain is rotated upward to a predetermined angle with respect to a ground, the first link and the second link are linearly connected to restrain upward rotation of the connection chain.

5. The wearable apparatus of claim 1, wherein the first coupling point is disposed below the second coupling point, and wherein, when the connection chain is parallel to a ground, a connection point at which the first link and the second link are rotatably coupled is disposed below a line that connects the second coupling point and the rotation point.

6. The wearable apparatus of claim 5, further comprising:

an elastic member that applies an elastic force to the first link or the second link to pull the connection point between the first link and the second link downward when the connection chain is rotated upward relative to a position parallel to the ground.

7. The wearable apparatus of claim 5, wherein the first link and the second link are rotatable to allow the connection point to be disposed above the line that connects the second coupling point and the rotation point, and the connection chain to be rotatable downward, relative to a position parallel to the ground, when the connection point is disposed above the line that connects the second coupling point and the rotation point.

8. The wearable apparatus of claim 1, wherein the connection chain includes a plurality of rotary elements which have a predetermined lateral length laterally, and are arranged laterally and rotatably coupled laterally to each other, and wherein the connection chain is bent from the back of the wearer to an outer side to allow the second end portion to extend to an outer side of the upper arm.

9. The wearable apparatus of claim 1, wherein the back support includes an upper plate supported on the back of the wearer, a lower plate disposed below the upper plate and supported on the back of the wearer, and a support link that extends in a vertical direction and is connected to the upper plate and the lower plate.

10. The wearable apparatus of claim 9, wherein the lower plate extends in a plate-like shape to correspond to a curve of the back of the wearer and is supported on the back of the wearer at a height of a pelvis of the wearer.

11. The wearable apparatus of claim 9, wherein the lower plate is coupled to the support link to be rotatable upward or downward.

12. The wearable apparatus of claim 11, wherein the lower plate is coupled to the support link to be rotatable at a third coupling point and a fourth coupling point disposed to be spaced apart from each other in the vertical direction.

13. The wearable apparatus of claim 12, wherein the third coupling point is disposed below the fourth coupling point, and the third coupling point is coupled to the support link at a position spaced apart from the fourth coupling point via a third link having each end rotatably coupled to the lower plate and the support link, respectively.

14. The wearable apparatus of claim 13, wherein the third link and the lower plate are coupled to each other to be slidable in the vertical direction.

* * * * *